US006324850B1

(12) United States Patent
Davis

(10) Patent No.: US 6,324,850 B1
(45) Date of Patent: Dec. 4, 2001

(54) BEVERAGE DISPENSE SYSTEM

(75) Inventor: Terrence Robert Davis, Hunt End (GB)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 09/711,214

(22) Filed: Nov. 9, 2000

(51) Int. Cl.[7] ..... F25B 21/02
(52) U.S. Cl. ..... 62/3.64; 62/389
(58) Field of Search ..... 62/3.2, 3.64, 389, 62/390; 222/146.6

(56) References Cited

U.S. PATENT DOCUMENTS 2,931,188 * 4/1960 Levit ..... 62/3.64
5,279,446 * 1/1994 Cooke et al. ..... 222/54
5,287,913 * 2/1994 Dunning et al. ..... 165/26
5,535,600 * 7/1996 Mills ..... 62/390
5,560,211 * 10/1996 Parker ..... 62/3.63
6,112,541 * 9/2000 Greene ..... 62/389
6,250,084 * 6/2001 Sato et al. ..... 62/3.64

* cited by examiner

*Primary Examiner*—Henry Bennett
*Assistant Examiner*—Melvin Jones
(74) *Attorney, Agent, or Firm*—Sten Erik Hakanson

(57) ABSTRACT

A beverage dispense system is designed to dispense a beverage, e.g. from a bulk supply, by chilling the beverage to a temperature close to its freezing point. The beverage dispense system includes a beverage recirculation loop and a water recirculation loop, two chillers (10, 24), both loops passing through both chillers, and a dispense valve (26) located in the beverage recirculation loop, a first of the chillers (10) cooling both the beverage and the water and a second of the chillers (24) comprising a thermo-electric device and being located between the first chiller (10) and the dispense valve (26) for further cooling of the beverage to be dispensed whilst removing heat from the device (24) using the water in the water recirculation loop.

25 Claims, 1 Drawing Sheet

BEVERAGE DISPENSE SYSTEM

FIELD OF THE INVENTION

This invention relates generally to a beverage dispense system in which a chilled beverage is presented to the consumer. It is particularly applicable to beverages such as beer or lager.

BACKGROUND OF THE INVENTION

Conventional beer/lager cooling systems typically have a bulk beverage supply located at a separate location (called a cellar room) from the bar counter and the beverage is chilled in the cellar by being passed through an ice bank cooler to a temperature just below its ultimate dispense temperature. The chilled beverage is then pumped from the cellar room to the bar within an insulated python.

If one wishes to dispense the beverage at very cold temperatures e.g. below 0° C., such a system has problems. In particular, one has to chill the beverage in the cellar room to an even lower temperature. Whilst one can utilise glycol mixtures in the ice bank cooler instead of water to obtain lower beverage temperatures, the lower the required beverage temperature the greater the risk that it will freeze solid in the cooler or the python during periods when the beverage is not being dispensed. It will then be impossible to operate the dispense system when the next drink is required to be dispensed.

It is therefore an object of the invention to provide a system which is capable of successfully dispensing a chilled beverage from a bulk supply to a temperature close to the freezing point of the beverage.

SUMMARY OF THE INVENTION

Accordingly the present invention provides a chilled beverage dispense system including a beverage recirculation loop and a water recirculation loop, a dispense valve located in the beverage recirculation loop, a first chiller, through which both loops pass, for cooling both the beverage and the water, and a second chiller through which both loops pass, the second chiller comprising a thermo-electric device and being located between the first chiller and the dispense valve whereby the beverage to be dispensed is further cooled in the second chiller and the water removes heat from the second chiller. The thermo-electric device is typically one or more layers of Peltier plate assemblies. As is well known, when connected to a voltage supply, a cold side and a hot side are generated at the assembly.

The first chiller may be a single ice bank cooler of conventional design with a portion of each recirculation loop immersed in water/ice within the cooler. Typically, the system is such that the first chiller cools both the beverage and the water to just above 0° C., say 0.5° C., whilst the second chiller may cool the beverage several degrees cooler (depending upon the freezing temperature of the beverage). With beer/lager, this may be cooler by a further 4° or 5° C., i.e. down to −3.5° C. or −4.5° C.

Water which has passed through the thermo-electric chilling device may also pass through one side of a heat exchanger before returning to the first chiller. The second side of such heat exchanger may carry recirculating beverage which has by-passed the dispense valve and is returning to the first chiller. The cold beverage may, thereby, be warmed from its below zero temperature before re-entering the first chiller. The second chiller is preferably actuated only when dispense from the dispense valve is required e.g. power is supplied to the Peltier (thermo-electric) device upon the pressing of a dispense button. After a predetermined dispense time or predetermined flow of beverage from the dispense valve, the power supply to the device may be cut off. Alternatively, at the end of the dispense cycle the current supplied to the thermo-electric device may be switched off and then reversed for a short time, e.g. a couple of seconds, before being switched off again. This slightly increases the beverage temperature in the device and avoids the risk of beverage freezing in this region. This slightly warmed beverage is not dispensed, since the control system will have closed the dispense valve before the warmed beverage reaches it.

During operation of the thermo-electric device to further chill the beverage before it is dispensed, the water passing through the thermo-electric device is warmed by the Peltier junction effect. As this water passes into the heat exchanger it acts to warm the recirculating beverage on its way back to the first chiller, as indicated above. The heat exchanger may be of the tube-in-tube type with water travelling parallel to the beverage.

In order to ensure that beverage which has been sufficiently chilled is dispensed, the dispense control system may provide for valve actuation (opening) only after the beverage exiting the second chiller has reached a predetermined temperature e.g. −4.5° C. This requires a temperature sensor, which may be located in the beverage recirculation loop between the second chiller and the dispense valve or in the dispense valve housing or even a little downstream of the dispense valve in the beverage recirculation loop. Alternatively, a time delay may be incorporated into the control system so as to open the valve a predetermined time after initiation.

In the event that the temperature of the beverage or water. returning to the first chiller is such that it is starting to freeze, it would then be warmed to the desired temperature in the first cooler. Moreover, as beverage and water continue to be pumped around the recirculation loops and the thermal mass should be sufficient to prevent any permanent freezing of the water or beverage. A water dispense valve may be provided in the water recirculation loop, preferably before the water enters the second chiller. Controlled quantities of chilled water may be dispensed from this valve in response to signals from the dispense control system. Typically such chilled water is projected or sprayed onto a beverage receptacle shortly before the opening of the beverage dispense valve. This enables the receptacle to be cooled by the chilled water ahead of, and possibly during or after, beverage dispense.

As either or both of the beverage and water recirculation loops are depleted by dispense, such loops are topped up by fresh liquid. Typically the incoming connections to the loops are located just ahead of the first chiller. Such incoming liquids may be at ambient temperature or they could be pre-chilled in high temperature environments.

The present invention provides a system in which cooler than usual beverage can be dispensed safely and without risk of freezing. A conventional ice bank cooler can be used for the initial cooling (first chiller) and to maintain the cooled effect between dispenses and the thermo-electric device (second chiller) is used to provide the extra cooling when required for a dispense and may also be used as a temperature control means in the manner indicated above. Between dispenses the second chiller is inactive and the system "idles" at the temperature achieved by the first chiller. The dispense valve is permanently chilled and so does not harmfully affect dispense temperature after standing unused. The system is simple to maintain with a minimum of moving parts and the risk of freezing is substantially eliminated.

DESCRIPTION OF THE DRAWINGS

A better understanding of the structure, function, operation and the objects and advantages of the present invention can be had by reference to the following detailed description which refers to the following figure, wherein.

DETAILED DESCRIPTION

Figure 1:
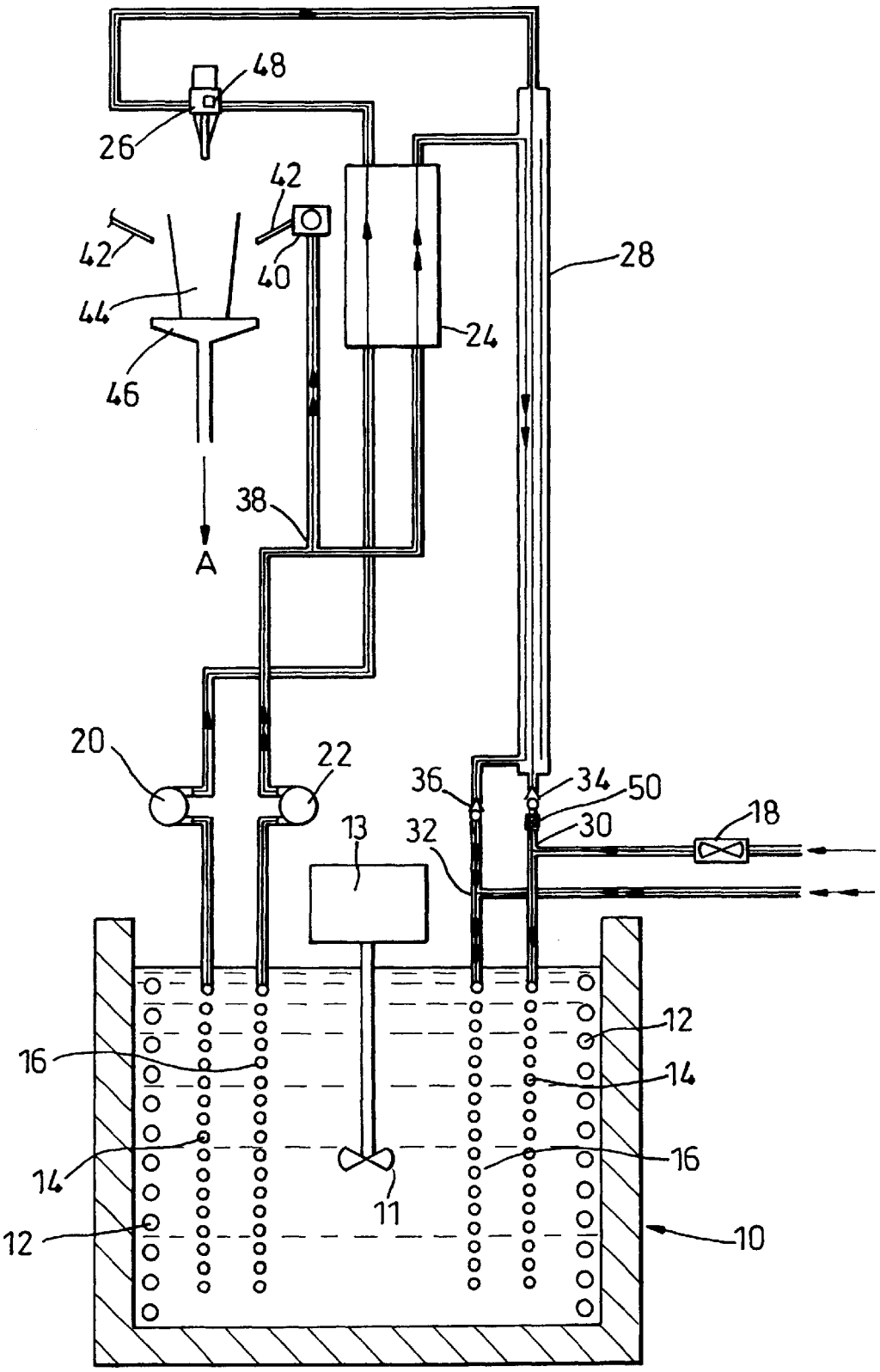
FIG. 1 shows a schematic representation of the dispense system of the present invention.

Embodiments of the invention will now be described by way of example only with reference to the accompanying drawing FIG. 1. A beverage recirculation loop from a remote beverage source (not shown) is indicted by single-headed arrows. A water recirculation loop, e.g. from the mains, is indicated by double-headed arrows. Both loops pass through a first chiller 10 which is an ice/water bath containing refrigeration coils 12 connected in conventional manner to a refrigerant circulation means (not shown). Beverage passes through chiller 10 in coils 14 and water in coils 16, which coils are all immersed in the ice/water in the bath. The chiller 10 also contains a paddle 11 driven by a motor 13 which operates to stir the contents of the bath. A flow turbine 18 is provided in the inlet to the beer recirculation loop. The beverage and the water are pumped around the respective recirculation loops by pumps 20, 22 respectively. From the first chiller 10 they are passed through a second chiller 24, which is a Peltier plate assembly generating a hot and a cold side by connection to a voltage supply (not shown). The beverage recirculation loop passes across the cold side of the assembly and the water recirculation loop passes across the hot side in order to remove the heat generated. As indicated above, the beverage and the water may be cooled to, for example, about 0.5° C. in the first chiller and the beverage may be cooled further to, say −3.5° C. to −4.5° C. in the second chiller. The water may be circulated at a higher rate, e.g. 6 to 7 litres/minute, than the beverage.

From second chiller 24 the beverage recirculation passes to dispense valve 26. If the valve is closed the beverage continues around its recirculation loop and returns to the first chiller 10 via a heat exchanger 28 and then via a T-junction 30 with its source supply line. The water warmed in the second chiller 24 also then passes through heat exchanger 28 before returning to the first chiller 10 via a T-junction 32 with its source supply line. One way check valves 34, 36 between the heat exchanger and the respective T-junctions ensure that the beverage and water cannot pass wrong-way around their recirculation loops.

A water branch line leading off from its recirculation loop at a junction 38 between the first and second chillers leads to a valve 40, which when opened dispenses cold water via jets 42 around a glass or other beverage receptacle 44 positioned beneath beverage dispense valve 26. Water valve 40 may be controlled to open for a period just before, during and/or after valve 26 is opened so that beverage is dispensed into a cooled receptacle. The receptacle is shown standing on a drip tray 46 through which the water may drain away as indicted by arrow A.

A temperature sensor 48 is in the beverage flow loop in valve 26. When a beverage dispense is activated, the temperature sensor 48 feeds the temperature information of the beverage to a control unit (not shown) and the second chiller 24 is activated. Beverage continues to circulate around its loop until its temperature at the valve 26 has reached the pre-programmed temperature and then the control unit activates opening of the valve 26. As the valve is opened, flow volume data may be fed from flow turbine 18 to the control unit, which then closes valve 26 when a predetermined volume has been dispensed. When the dispense valve is closed, the current to the second chiller may be reversed for a few seconds to increase beverage temperature a little to eliminate the possibility of any ice formation.

The flow turbine 18 may, if desired, be positioned closer to the dispense valve 26, e.g. between that valve and the second chiller. Valve 50, shown positioned between check valve 34 and T-junction 30 in the beverage recirculation loop is then activated to close the recirculation loop during dispense so that the flow turbine registers only flow through valve 26. A purge tap may conveniently be added to each recirculation loop, e.g. between heat exchanger 28 and the check valves 34, 36 so that the system may be primed to remove air before first use.

What is claimed is:

1. A chilled beverage dispense system including a beverage recirculation loop and a water recirculation loop, a dispense valve located in said beverage recirculation loop, a first chiller, through which both loops pass for cooling both the beverage and the water, and a second chiller through which both loops pass, said second chiller comprising a thermo-electric device and being located between the first chiller and the dispense valve whereby the beverage to be dispensed is further cooled in the second chiller and the water removes heat from the second chiller.

2. A chilled beverage dispense system according to claim 1, in which the thermo-electric device comprises at least one layer of Peltier plate assemblies.

3. A chilled beverage dispense system according to claim 1, in which the first chiller is a single ice bank cooler and a portion of each of said recirculation loops is immersed in water and ice within the cooler.

4. A chilled beverage dispense system according to claim 1, in which the first chiller cools both the water and the beverage to just above 0° C. and the second chiller cools the beverage several degrees cooler.

5. A chilled beverage dispense system according to claim 4, in which the second chiller cools the beverage to −3.5° C. to −4.5° C.

6. A chilled beverage dispense system according to claim 1, which includes a heat exchanger and in which the water which has passed through the second chiller passes through one side of said heat exchanger before returning to the first chiller.

7. A chilled beverage dispense system according to claim 6, in which recirculating beverage which has passed the dispense valve passes through the other side of the heat exchanger before returning to the first chiller.

8. A chilled beverage dispense system according to claim 6, in which the heat exchanger is of the tube-in-tube type.

9. A chilled beverage dispense system according to claim 7, in which the heat exchanger is of the tube-in-tube type.

10. A chilled beverage dispense system according to claim 1, in which the second chiller is only actuated when dispense from the dispense valve is required.

11. A chilled beverage dispense system according to claim 10, in which the second chiller has a power supply which is arranged to be switched off after a predetermined dispense time.

12. A chilled beverage dispense system according to claim 10, in which the second chiller has a power supply which is arranged to be switched off after a predetermined flow of beverage from the dispense valve.

13. A chilled beverage dispense system according to claim 1, in which the thermo-electric device has a power supply which, at the end of a dispense, the power to the thermo-electric device is arranged to be switched off, reversed and switched on again for a short time and then switched off again.

14. A chilled beverage dispense system according to claim 1, which includes a dispense control which is connected to a temperature sensor in the beverage recirculation loop, said control allowing the opening of the dispense valve only after the beverage has reached a predetermined temperature.

15. A chilled beverage dispense system according to claim 14, in which the temperature sensor is located between the second chiller and the dispense valve.

16. A chilled beverage dispense system according to claim 14, in which the temperature sensor is located in a housing in which the dispense valve is located.

17. A chilled beverage dispense system according to claim 14, in which the temperature sensor is located just downstream of the dispense valve in the beverage recirculation loop.

18. A chilled beverage dispense system according to claim 1, having a dispense control incorporating a time delay to open the dispense valve a predetermined time after actuation of the second chiller.

19. A chilled beverage dispense system according to claim 1, in which a water dispense valve is provided in the water recirculation loop.

20. A chilled beverage dispense system according to claim 19, in which said water dispense valve is positioned in said loop before the water reaches the second chiller.

21. A chilled beverage dispense system according to claim 19, in which controlled quantities of chilled water may be dispensed from the water dispense valve in response to signals from a dispense control.

22. A chilled beverage dispense system according to claim 19, in which the dispensed chilled water is passed to means to project or spray it onto a receptacle to receive the dispensed beverage.

23. A chilled beverage dispense system according to claim 1, which includes a connection to each of said recirculation loops before the first chiller, one of said connections being connected to a source of said beverage and the other of said connections being connected to a source of said water, whereby said loops may be replenished as required.

24. A chilled beverage dispense system according to claim 1, which includes a flow meter to measure the quantity of beverage dispensed.

25. A chilled beverage dispense system according to claim 1, which includes a purge tap in each of said recirculation loops.

* * * * *